US008490745B2

(12) United States Patent
Wirth et al.

(10) Patent No.: US 8,490,745 B2
(45) Date of Patent: Jul. 23, 2013

(54) EXHAUST SYSTEM COMPONENT

(75) Inventors: Georg Wirth, Kircheim/Teck (DE); Jan Krüger, Neuhausen (DE)

(73) Assignee: Eberspächer Exhaust Technology GmbH & Co. KG, Neunkirchen (DE)

( * ) Notice: Subject to any disclaimer, the term of this patent is extended or adjusted under 35 U.S.C. 154(b) by 0 days.

(21) Appl. No.: 13/468,310

(22) Filed: May 10, 2012

(65) Prior Publication Data

US 2012/0285766 A1 Nov. 15, 2012

(51) Int. Cl.
*F01N 13/08* (2010.01)

(52) U.S. Cl.
USPC ..... 181/228; 181/227; 181/212; 181/283; 181/282; 181/246

(58) Field of Classification Search
USPC ..... 181/283, 282, 212, 228, 246
See application file for complete search history.

(56) References Cited

U.S. PATENT DOCUMENTS

| | | | | |
|---|---|---|---|---|
| 1,671,829 | A * | 5/1928 | Ledwinka | 181/283 |
| 5,340,952 | A * | 8/1994 | Takiguchi | 181/282 |
| 5,468,923 | A * | 11/1995 | Kleyn | 181/282 |
| 5,723,828 | A * | 3/1998 | Nakagawa | 181/250 |
| 6,230,488 | B1 * | 5/2001 | Voss | 60/298 |
| 8,047,328 | B1 * | 11/2011 | Milewicz et al. | 181/246 |
| 2007/0074930 | A1 * | 4/2007 | Tomerlin et al. | 181/252 |
| 2009/0078499 | A1 * | 3/2009 | Sikes et al. | 181/256 |
| 2009/0194364 | A1 | 8/2009 | Leboeuf et al. | |
| 2011/0005857 | A1 * | 1/2011 | Pommerer et al. | 181/212 |

FOREIGN PATENT DOCUMENTS

| | | | |
|---|---|---|---|
| DE | 40 33 858 | C2 | 1/1993 |
| GB | 2 237 327 | A | 5/1991 |
| WO | 2009/099 986 | A2 | 8/2009 |
| WO | 2011/047852 | A1 | 4/2011 |

* cited by examiner

*Primary Examiner* — Forrest M Phillips
(74) *Attorney, Agent, or Firm* — McGlew and Tuttle, P.C.

(57) ABSTRACT

An exhaust system component (1) of an exhaust system (2) for an internal combustion engine, especially of a motor vehicle has an inner pipe (3) made of metal, which is exposed to exhaust gas during the operation of the exhaust system (2), a housing (4) made of plastic, which encloses a working space (6), and an outer pipe (5) made of metal. The outer pipe (5) is fastened at a first end area (7) to the inner pipe (3) and is rigidly connected at a second end area (9) to the housing (4) and encloses between these end areas (7, 9) an annular space (10) formed radially between the inner pipe (3) and outer pipe (5).

20 Claims, 5 Drawing Sheets

EXHAUST SYSTEM COMPONENT

CROSS REFERENCE TO RELATED APPLICATIONS

This application claims the benefit of priority under 35 U.S.C. §119 of German Patent Application DE 10 2011 075 643.4 filed May 11, 2011, the entire contents of which are incorporated herein by reference.

FIELD OF THE INVENTION

The present invention pertains to an exhaust system component of an exhaust system for an internal combustion engine, especially of a motor vehicle.

BACKGROUND OF THE INVENTION

Exhaust system components are, for example, mufflers, catalytic converters, particle filters, SCR systems, NOX storage systems as well as any desired combinations thereof. To reduce the fuel consumption of motor vehicles, attempts are made to reduce the weight of the motor vehicle. This can be achieved, for example, by using light metals instead of iron metals and/or plastics instead of metals in order to manufacture vehicle components that are characterized by a low weight. Since plastics have a low temperature stability compared to metals, the use of plastics in the area of an exhaust system is associated with great difficulties.

SUMMARY OF THE INVENTION

An object of the present invention is to provide an exhaust system component made at least partly from plastic.

According to the invention, an exhaust system component of an internal combustion engine exhaust system is provided comprising an inner pipe made of metal, which is exposed to exhaust gas during operation of the exhaust system, a housing made of plastic, which encloses a working space and an outer pipe made of metal. The outer pipe comprises a first end area connected to the inner pipe and a second end area rigidly connected to the housing and enclosing an annular space formed radially between the inner pipe and the outer pipe between the first end area and the second end area.

The present invention is based on the general idea of manufacturing a component, to which hot exhaust gases are not admitted directly, from plastic in an exhaust system component and of fastening same to a metallic component, to which exhaust gas can now be admitted directly, via a metallic component, to which likewise no exhaust gas is admitted directly. The heat transfer into the plastic component can be significantly reduced via this indirect connection of the plastic component with the metal component that is subject to a higher thermal load via a metal component that is subject to low thermal load. As a result, the thermal load of the plastic component remains within the thermal load limits of the plastic component, as a result of which the desired fatigue strength can be obtained for the exhaust system component of a hybrid design.

It is specifically provided that the exhaust system component be equipped with at least one inner pipe made of metal, with a housing made of plastic and with at least one outer pipe made of metal. The inner pipe is exposed to exhaust gas during the operation of the exhaust system. It is used especially to guide the exhaust gas. The housing encloses a working space. The outer pipe is fastened to the inner pipe in a first end area and is rigidly connected to the housing in a second end area. Furthermore, an annular space formed radially between the interior space and outer pipe is provided between the end areas of the outer pipe. A direct contact between the housing and inner pipe is avoided due to this design, which reduces the thermal load on the housing. The arrangement of the outer pipe at the inner pipe in such a way that an annular space is formed leads to a so-called air gap insulation between the outer pipe and inner pipe, which considerably reduces the thermal load on the outer pipe. The outer pipe is correspondingly markedly cooler than the inner pipe, which reduces the amount of heat introduced into the housing.

Corresponding to an advantageous embodiment, the housing may be molded onto the outer pipe. By molding the plastic onto the outer pipe, the second end area of the connection pipe can be embedded into the plastic of the housing, as a result of which it is possible, in particular, to achieve intensive positive locking. The molding of the plastic component onto the metal component leads, besides, to effective sealing without additional sealing elements having to be used.

Especially advantageous is a variant in which molding-on contours, which form a positive-locking connection with the housing molded on, are formed integrally at the second end area of the outer pipe. For example, these molding-on contours may have perforations and/or undercuts, which make possible the intensive anchoring of the second end area in the plastic of the housing. The molding-on contours may be configured, for example, in a flap-like or strap-like manner and may especially consist of a plurality of members. A plurality of molding-on contours may likewise be arranged distributed in the circumferential direction of the outer pipe.

According to an advantageous embodiment, the outer pipe may have a wavy profile in the circumferential direction or in the longitudinal direction, which ensures a large surface of the outer pipe and thus makes possible a better heat dissipation into the environment of the outer pipe. The heat transfer from the inner pipe to the housing via the outer pipe can be reduced in this manner.

In addition or as an alternative, the outer pipe may have on its outside a passive cooling structure, which likewise leads to an enlarged surface of the outer pipe and correspondingly supports the release of heat to the environment.

According to an advantageous variant, the cooling structure may have a plurality of ring disk-like cooling ribs. Such cooling ribs may be welded or soldered to the outer pipe individually. A cooler block, which has a plurality of such ring disk-like cooling ribs, may likewise be attached to the outer pipe from the outside and connected thereto. Furthermore, it is possible to design the cooling structure such that it has at least one cooling coil wound helically around the outer pipe. The cooling coil may also be welded or soldered to the outer pipe.

In another advantageous embodiment, a heat-insulating insulation material may be arranged in the annular gap in order to further reduce the thermal load on the outer pipe.

Another embodiment provides that a sliding fit be formed between the housing and inner pipe, so that even though there can be support between the housing and inner pipe, relative motions between the housing and inner pipe continue to be possible, e.g., in order to make thermal expansions possible without stresses. Especially advantageous here is an embodiment in which the housing carries a slide bearing, via which support is established between the housing and inner pipe, so that there is no direct contact between the housing and inner pipe. Such a slide bearing may be embodied, for example, by means of Teflon or by means of PEEK (Polyetheretherketone) or by means of polyimide or by means of a wire mesh. Combinations of the above materials are conceivable as well.

In another embodiment, the exhaust system component may be designed such that the housing is held exclusively via a single such outer pipe at the inner pipe. The exhaust gas is not flowing through the inner pipe during the operation of the exhaust system, but it is used to connect the exhaust system component to an exhaust pipe of the exhaust system component, through which pipe the exhaust gas flows during the operation of the exhaust system. Thus, the exhaust gas also does not flow through the working space of the housing, but is in bypass to the exhaust gas flow. The inner pipe may be connected to the exhaust pipe directly or indirectly via a corresponding connection piece, and said connection piece may be designed especially as a Y-pipe and/or as a double-shell connection piece.

According to a variant, the exhaust system component may be an active muffler, which is connected to the exhaust system via the inner pipe. A loudspeaker of the active muffler is in this case arranged in the working space, and the working space may, besides, form a front chamber as well as a rear chamber for the loudspeaker. The inner pipe is used for acoustic coupling and the exhaust gas of the exhaust system does not flow through it, because the active muffler is connected in bypass to the exhaust pipe of the exhaust system, through which the exhaust gas flows. As an alternative, the exhaust system component may be a Helmholtz resonator, which is acoustically connected to the exhaust system via the inner pipe. The working space forms in this case the resonance space of the Helmholtz resonator, while the inner pipe forms the resonator neck of the Helmholtz resonator. Such a Helmholtz resonator is usually also connected in bypass to the exhaust pipe, through which the exhaust gas flows.

According to another advantageous embodiment, the housing may be held at the inner pipe via two such outer pipes. An embodiment, in which the exhaust gas flows through the inner pipe during the operation of the exhaust system, is possible, in particular, in this case. For example, the exhaust system component may be a passive muffler in this case, and the inner pipe may be perforated and/or interrupted in this case. The acoustic coupling between the exhaust gas flow and the working space of the housing takes place via the perforation or interruption of the inner pipe. The working space may in this case be used as an absorption space and/or as a reflection space and/or as an expansion space and/or as a resonance space, depending on the type and design of the muffler. If the working space is used as an absorption space, it may also be filled especially with an absorption material.

Corresponding to an advantageous embodiment, fastening points, by means of which the exhaust system component can be fastened to a support structure, especially to a body of the vehicle, may be arranged on the outer pipe. Such fastening points are usually formed on the housing. However, arranging of such fastening points on the metallic outer pipe is preferred in the hybrid exhaust system component being presented here in order to reduce the mechanical load on the housing.

At least one fastening element of a fastening means, by means of which the exhaust system component can be fastened to a support structure, may be arranged for this, in particular, on the corresponding outer pipe. The corresponding fastening element may be welded or soldered to the outer pipe. The fastening element may be a strap, a bracket or an angle. The support structure is preferably a vehicle body or an underbody of the vehicle. The exhaust system component is fastened to the support structure especially exclusively via the outer pipe, as a result of which the housing is relieved of mechanical load.

It is apparent that the above-mentioned features, which will also be explained below, can be used not only in the respective combination indicated, but also in other combinations or alone, without going beyond the scope of the present invention.

Preferred embodiments of the present invention are shown in the drawings and will be explained in more detail below, with identical or similar or functionally identical components being designated by the same reference numbers. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 10:
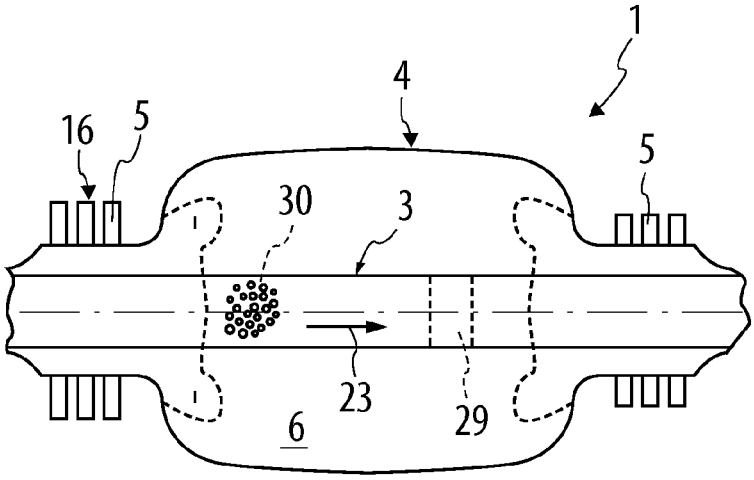
FIG. 10 is a side schematic view of an exhaust system component in another embodiment.
Figure 11:
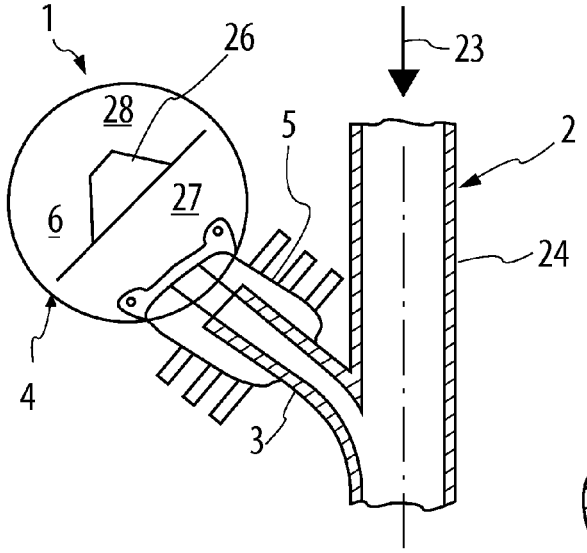
FIG. 11 is a highly simplified longitudinal sectional view of an exhaust system in the area of an exhaust system component showing one of different embodiments.
Figure 12:
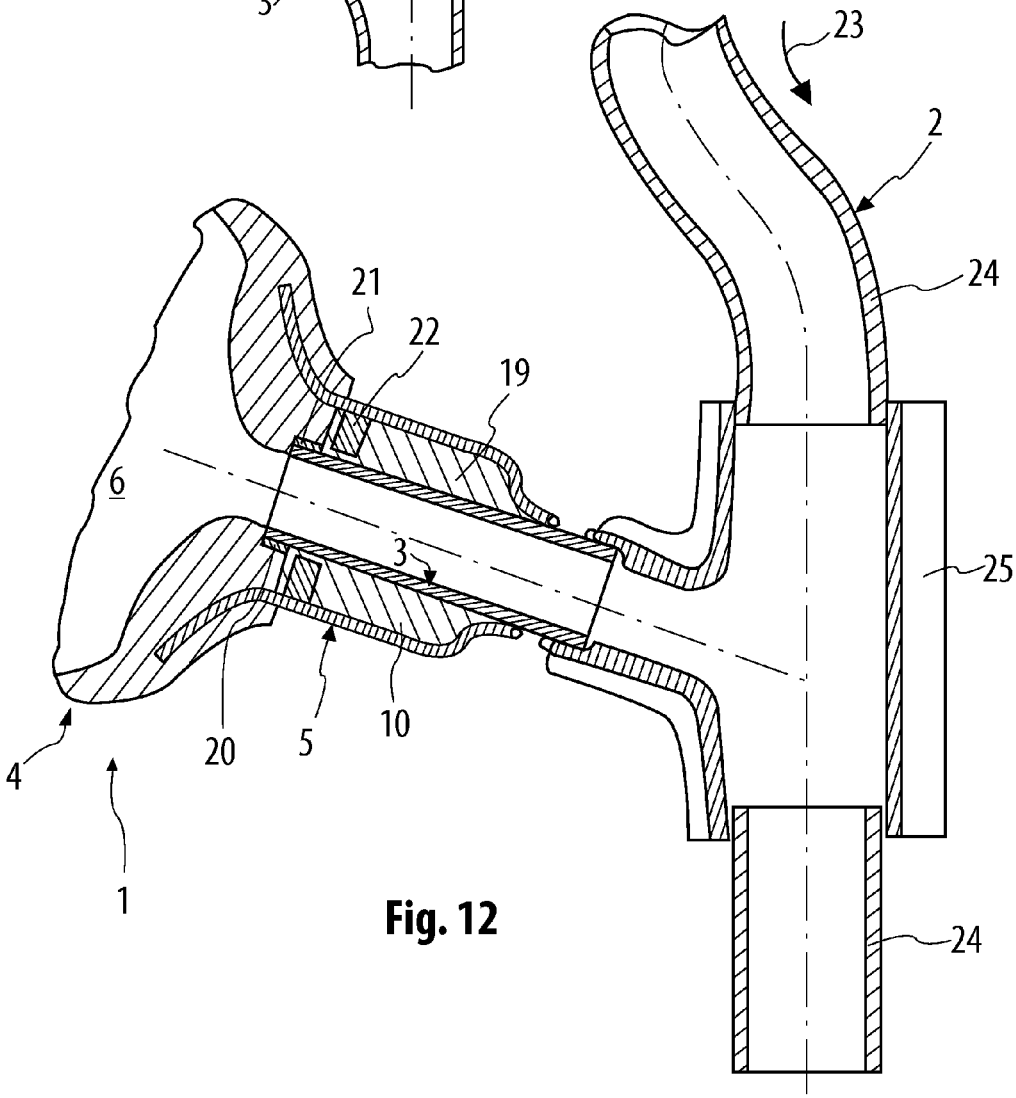
FIG. 12 is a highly simplified longitudinal sectional view of an exhaust system in the area of an exhaust system component showing one of different embodiments.

Referring to the drawings in particular, corresponding to FIGS. 1 through 12, an exhaust system component 1, which is intended for installation in an exhaust system 2 of an internal combustion engine, preferably of a motor vehicle, which said exhaust system is shown partly in FIGS. 11 and 12, comprises at least one inner pipe 3, at least one housing 4 and at least one outer pipe 5. The inner pipe 3 is made of metal and is exposed to exhaust gas of the internal combustion engine during the operation of the exhaust system 2. The exhaust gas does not necessarily have to flow through the inner pipe 3. Housing 4 is made of a plastic and encloses a working space 6. The outer pipe 5 is again made of metal and is fastened in a first end area 7 to the inner pipe 3, e.g., by means of a welded connection 8. The outer pipe 5 is rigidly connected to housing 4 in a second end area 9 located away from the first end area 7. Furthermore, the outer pipe 5 is arranged and dimensioned in relation to the inner pipe 3 such that it encloses between its end areas 7, 9 an annular space 10 formed radially between the inner pipe 3 and outer pipe 5 in the circumferential direction. This annular space creates an air gap insulation between the inner pipe 3 and outer pipe 5.

The relative direction data such as "circumferential direction" and "radial" or "axial" refer in this connection to a central longitudinal axis 15 of the inner pipe 3.

Housing 4 is arranged in relation to the inner pipe 3 in a contactless manner in the embodiments according to FIGS. 1 through 12, so that housing 4 is connected to the inner pipe 3 exclusively via the outer pipe 5.

Housing 4 is preferably molded onto the outer pipe 5, as a result of which the second end area 9 is embedded into the plastic of housing 4. In particular, the plastic of housing 4 thus can enclose the second end area 9 of the outer pipe 5 on both sides, i.e., radially on the inside and outside.

Molding-on contours 11, which are designed such that they form a positive-locking connection with the integrally molded housing 4, are advantageously formed integrally at the second end area 9 of outer pipe 5. The molding-on contours 11 may be, e.g., a plurality of straps 12 arranged distributed in the circumferential direction, which may comprise one member according to FIG. 2 or a plurality of members according to FIG. 4. Perforations 13, in which the injection-molded plastic is interspersed, are formed in the molding-on contours 11. The molding-on contours 11 may be stepped according to FIG. 3 in order to form undercuts, which are surrounded by the plastic in a positive-locking manner.

Figure 5:
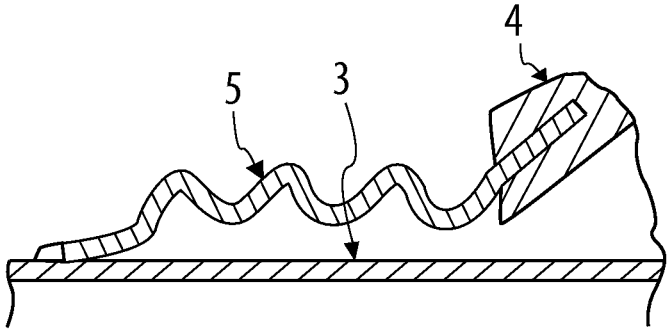
FIG. 5 is a partial (half) longitudinal sectional view through an exhaust system component in the area of an outer pipe.
Figure 6:
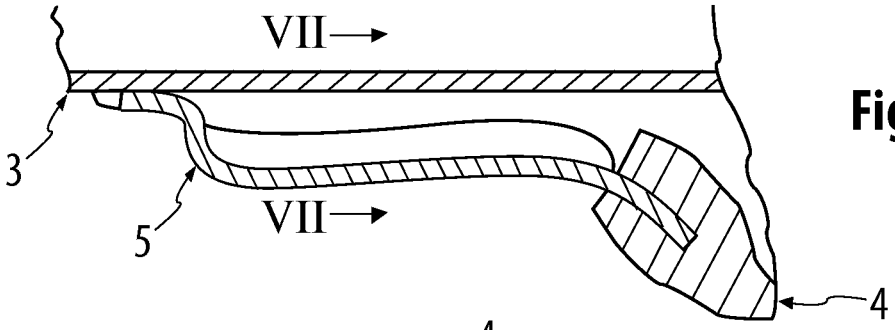
FIG. 6 is a partial (half) longitudinal sectional view as in FIG. 5, but for another embodiment.
Figure 7:
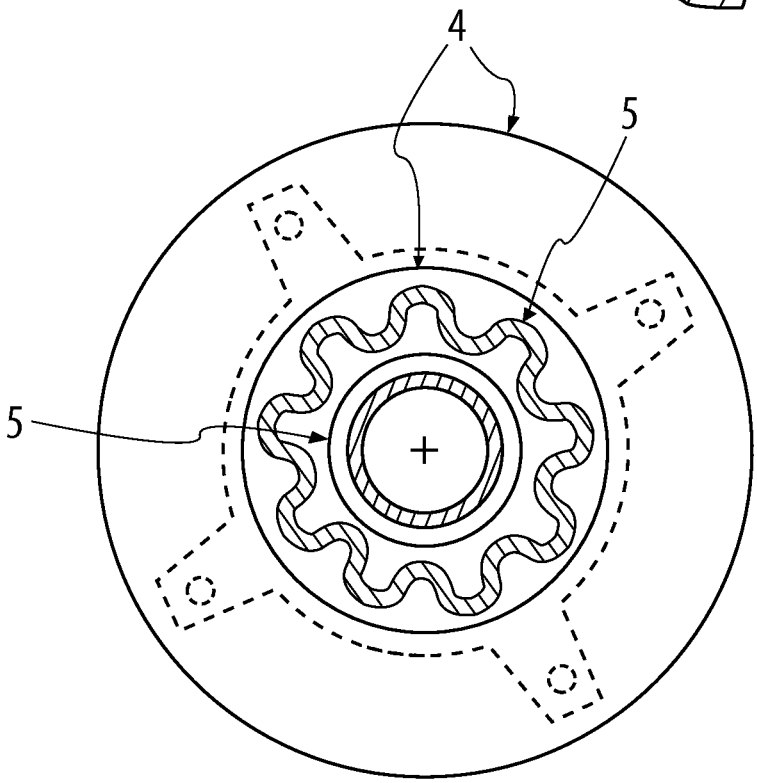
FIG. 7 is a cross sectional view of the exhaust system component corresponding to section lines VII in FIG. 6.
Figure 8:
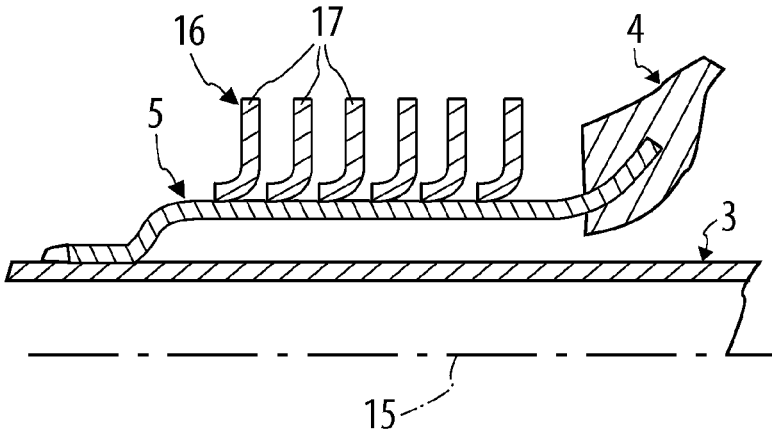
FIG. 8 is a partial (half) longitudinal sectional view of the exhaust system component in the area of an outer pipe showing one of different embodiments.
Figure 9:
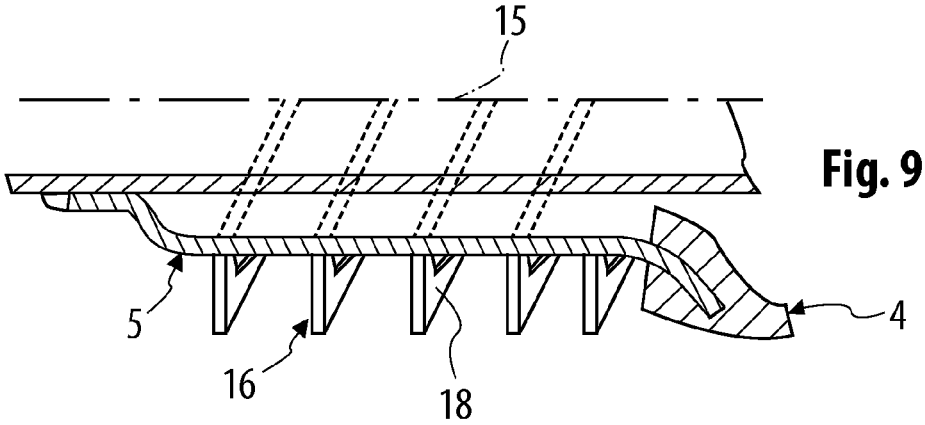
FIG. 9 is a partial (half) longitudinal sectional view of the exhaust system component in the area of an outer pipe showing another of different embodiments.

In the embodiment shown in FIG. 5, outer pipe 5 has a wavy profile in the longitudinal direction, as a result of which the outer pipe 5 has a beam-like design. The outer pipe 5 in the embodiment shown in FIGS. 6 and 7 has a wavy profile in the circumferential direction. The corresponding wavy profile of the outer pipe 5 enlarges the surface of the outer pipe 5, which facilitates the release of heat from the outer pipe 5 to the environment.

In the embodiments according to FIGS. 8 through 11, the outer pipe 5 is provided on its outside with a passive cooling structure 16 in order to improve the release of heat to the environment. Corresponding to FIG. 6, the cooling structure 16 may have, e.g., a plurality of ring disk-like cooling ribs 17, which may be welded or soldered to the outer pipe 5, especially individually. In the embodiment shown in FIG. 9, the cooling structure 16 comprises at least one cooling coil 18, which is wound helically around the outer pipe 5. The cooling coil 18 is also advantageously welded or soldered to the outer pipe 5.

In the embodiment shown in FIG. 12, a heat-insulating insulation material 19 is inserted into the annular gap 10 in order to reduce the heat transfer from the inner pipe 3 to the outer pipe 5. Furthermore, a sliding fit 20 is formed between housing 4 and inner pipe 3 in the embodiment shown in FIG. 12, so that a direct or indirect support can take place between housing 4 and inner pipe 3. However, a slide bearing 21, which is borne especially by housing 4, is preferably provided to embody the sliding fit 20. Slide bearing 21 may be embodied, e.g., during the injection molding of housing 4 in the form of an insert inserted into the injection mold, which is integrated in terms of its shape into the housing 4 during the injection molding of housing 4. Slide bearing 21 may be made, e.g., of Teflon, PEEK, polyimide, or wire mesh. In addition or as an alternative, it is also possible to provide besides, according to FIG. 12, a plain bearing 22, which makes possible a radial support between inner pipe 3 and outer pipe 5. This plain bearing 22 may also be made of Teflon or PEEK or polyimide or wire mesh. It is possible to take the plain bearing 22 into account during the injection molding of housing 4 already in the form of an insert in the injection mold in this case as well.

In the embodiments according to FIGS. 11 and 12, housing 4 is held at inner pipe 3 exclusively via a single outer pipe 5. The exhaust gas does not flow through the inner pipe 3 during the operation of the exhaust system 2 in these embodiments. An exhaust gas flow is indicated by an arrow 23 in FIGS. 11 and 12. Inner pipe 3 is connected to an exhaust pipe 24 of exhaust system 2, through which said exhaust pipe the exhaust gas flows during the operation of the exhaust system 2. Inner pipe 3 is connected directly to exhaust pipe 24 in the embodiment shown in FIG. 11. A connection piece 25, via which inner pipe 3 is connected to exhaust pipe 24, is provided in the embodiment shown in FIG. 12. Connection piece 25 is designed as a Y-pipe and has double shells in the example according to FIG. 12.

Exhaust system component 1 may be, e.g., an active muffler, which may also be designated hereinafter by 1, and is acoustically connected to the exhaust system 2 via inner pipe 3. According to FIG. 11, the active muffler 1 may contain a loudspeaker 26 in the working space 6 of housing 4, and a front chamber 27 and a rear chamber 28 of loudspeaker 26 are also contained, besides in working space 6. There is no flow through inner pipe 3, but said inner pipe makes possible an acoustic coupling between muffler 26 and exhaust pipe 24.

As an alternative, exhaust system component 1 may also be a Helmholtz resonator, which can likewise be designated by 1 below and which is connected acoustically to the exhaust system 2 via inner pipe 3. Corresponding to FIG. 12, working space 6 of housing 4 in this case forms a resonance space of the Helmholtz resonator 1. Inner pipe 3 in this case forms a resonator neck of the Helmholtz resonator 1. There is no flow of exhaust gas through the inner pipe 3 here, either, but inner pipe 3 makes vibration coupling possible between resonance space 6 and exhaust pipe 24.

Housing 4 is held via two outer pipes 5 at the inner pipe 3 in the embodiment shown in FIG. 10. The exhaust gas can flow through the inner pipe 3 during the operation of the exhaust system 2 in this case. A corresponding exhaust gas flow is indicated by an arrow 23 in FIG. 10 as well. The exhaust system component 1 may be advantageously designed as a passive muffler in such a case Inner pipe 3 is provided in this case within the housing 4, for example, with an interruption 29 and/or with a perforation 30, as a result of which acoustic coupling is made possible between the interior of inner pipe 3 and working space 6 of housing 4. Working space 4 may in this case be used as an absorption space and/or as a reflection space and/or as an expansion space and/or as a resonance space. In particular, working space 6 may be filled with an absorption material.

Figure 1:
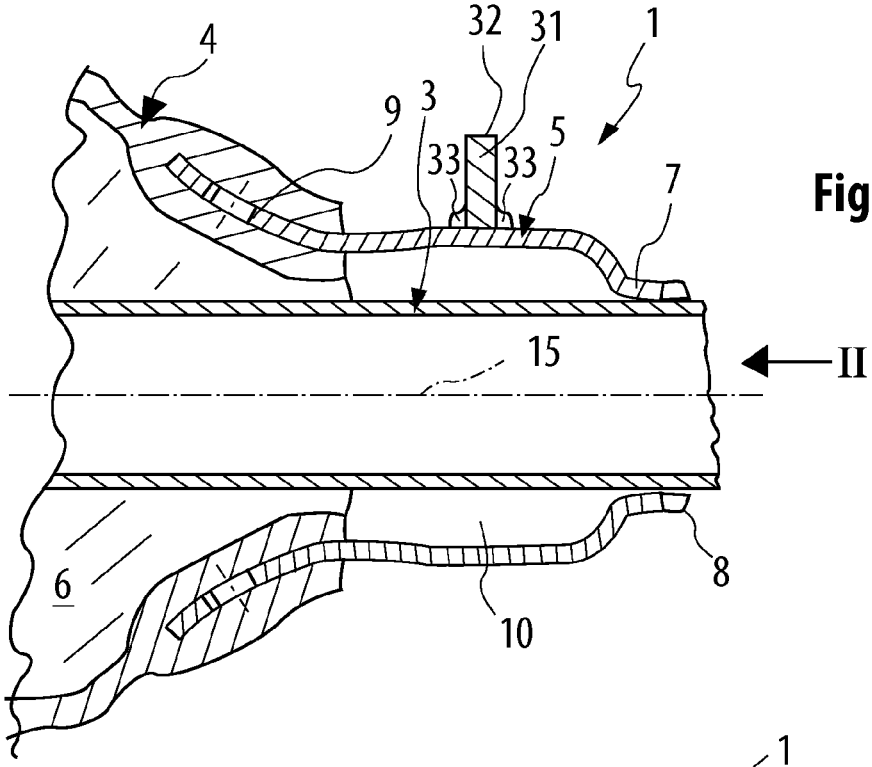
FIG. 1 is a longitudinal sectional view through a part of an exhaust system component.
Figure 2:
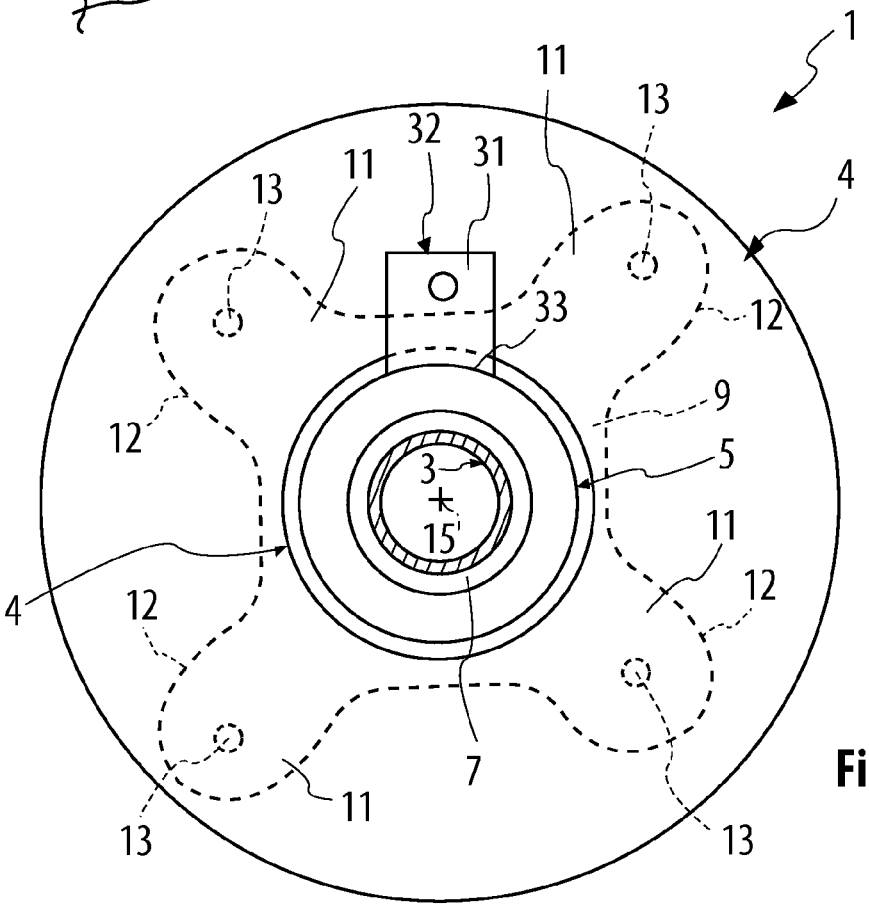
FIG. 2 is an axial view of the exhaust system component corresponding to direction of view II in FIG. 1.
Figure 3:
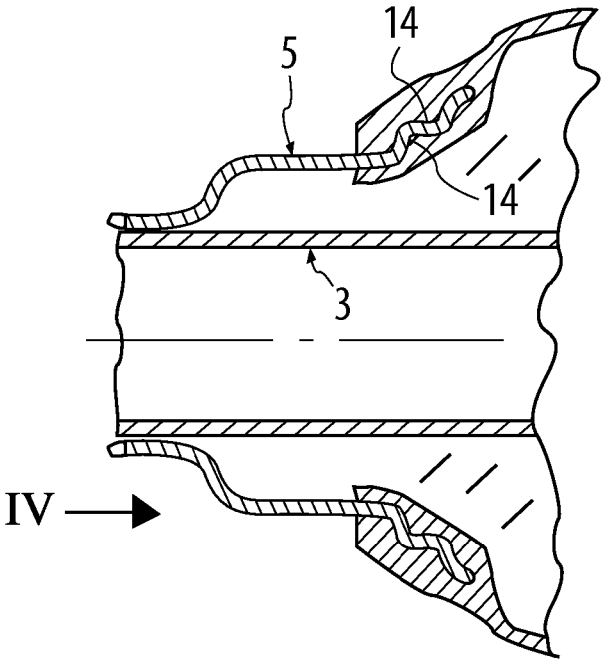
FIG. 3 is a longitudinal sectional view through another exhaust system component, in another area.
Figure 4:
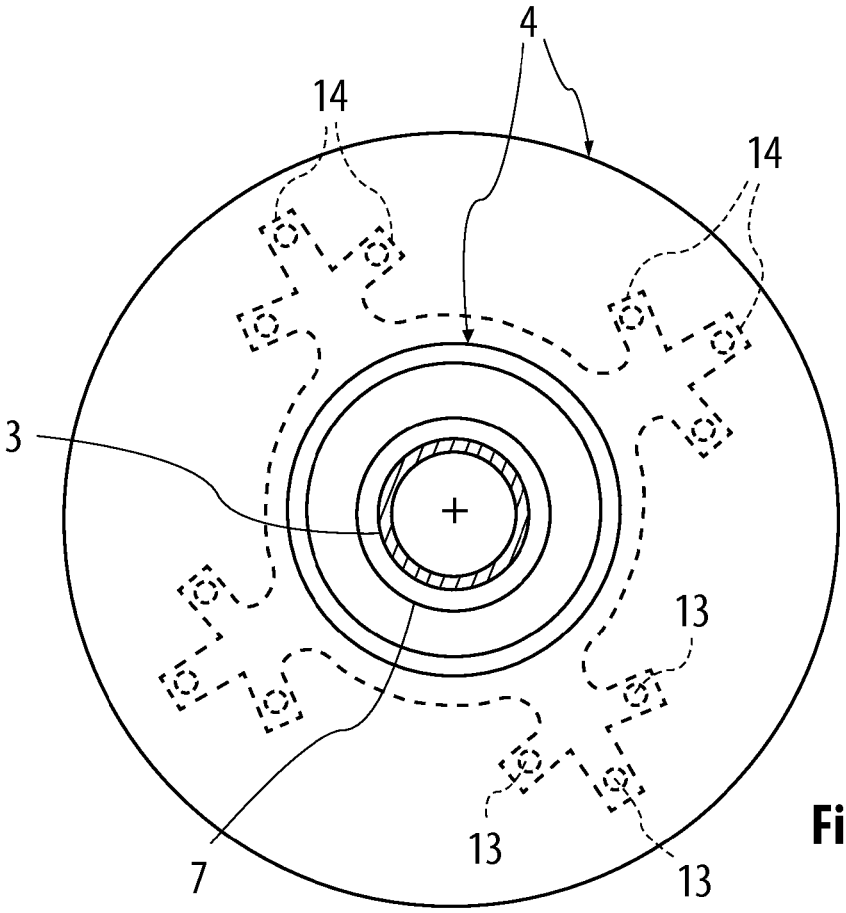
FIG. 4 is an axial view of the exhaust system component corresponding to direction of view IV in FIG. 3.

At least one fastening element 31 of a fastening means 32, by means of which fastening element 31 the exhaust system component 1 can be fastened to a support structure, not shown here, may be fastened to the respective outer pipe 5 in a preferred embodiment according to FIGS. 1 and 2. For example, fastening element 31 is designed here in the form of a strap, which can be fixed to the outer pipe 5 by means of a welded connection 33. For example, a screw connection of the exhaust system component 1 with the support structure can be embodied by means of strap 31. The support structure may be, for example, a vehicle body, especially an underbody of the vehicle. The exhaust system component 1 is preferably fixed to the corresponding support structure exclusively by means of such fastening elements 31, which are arranged on outer pipe 5, so that it is possible, in particular, to avoid an additional mechanical load on housing 4.

While specific embodiments of the invention have been shown and described in detail to illustrate the application of the principles of the invention, it will be understood that the invention may be embodied otherwise without departing from such principles.

What is claimed is:

1. An exhaust system component of an internal combustion engine exhaust system, the component comprising:

an inner pipe made of metal, which is exposed to exhaust gas during operation of the exhaust system;

a housing made of plastic, which encloses a working space; and an outer pipe made of metal, said outer pipe comprising a first end area connected to said inner pipe and a second end area rigidly connected to said housing and enclosing an annular space formed radially between said inner pipe and said outer pipe between said first end area and said second end area, said housing being molded onto said outer pipe to provide a molded-on housing, wherein molding-on contours, which form a positive-locking connection with said molded-on housing, are formed integrally at said second end area of said outer pipe.

2. An exhaust system component in accordance with claim 1, wherein said outer pipe has at least one of:

a wavy profile in a circumferential direction; and a wavy profile in a longitudinal direction.

3. An exhaust system component in accordance with claim 1, further comprising a passive cooling structure on an outer side of said outer pipe.

4. An exhaust system component in accordance with claim 3, wherein at least one of:

said cooling structure has a plurality of ring disk-like cooling ribs, and said cooling structure has at least one cooling coil wound helically around said outer pipe.

5. An exhaust system component in accordance with claim 1, further comprising a heat-insulating insulation material arranged in said annular gap.

6. An exhaust system component in accordance with claim 1, further comprising a sliding fit between said housing and said inner pipe.

7. An exhaust system component in accordance with claim 1, wherein:

the component cooperates with an exhaust pipe through which exhaust gas of the exhaust system flows during the operation of the exhaust system;

said housing is held at said inner pipe only via a single said outer pipe;

exhaust gas does not flow through said inner pipe during the operation of the exhaust system; and said inner pipe is connected to the exhaust pipe.

8. An exhaust system component in accordance with claim 7, wherein the exhaust system component is one of:

an active muffler, which is acoustically connected to the exhaust system via said inner pipe;

a Helmholtz resonator, which is acoustically connected to the exhaust system via the inner pipe.

9. An exhaust system component in accordance with claim 1, further comprising another outer pipe to provide two outer pipes, wherein:

said housing is held at said inner pipe via said two outer pipes; and said exhaust gas flows through said inner pipe during operation of the exhaust system.

10. An exhaust system component in accordance with claim 9, wherein the exhaust system component is a passive muffler, wherein said inner pipe is perforated and/or interrupted.

11. An exhaust system component in accordance with claim 1, further comprising:

a fastening element of a fastening means for fastening the exhaust system component to a support structure, said fastening element being arranged at said outer pipe.

12. An exhaust system component in accordance with claim 1, wherein said exhaust system component further comprises another metal outer pipe to provide two outer pipes, wherein:

said plastic housing is held at said metal inner pipe via said two outer pipes;

said exhaust gas flows through said metal inner pipe during operation of the exhaust system;

said exhaust system component is a passive muffler, wherein said metal inner pipe is perforated and/or interrupted.

13. A motor vehicle internal combustion engine exhaust system comprising an exhaust system component, said exhaust system component comprising:

a metal inner pipe having an inner surface in communication with exhaust gas during operation of the exhaust system;

a plastic housing enclosing a working space; and a metal outer pipe comprising a first end area connected to said metal inner pipe and a second end area rigidly connected to said plastic housing and enclosing an annular space formed radially between said metal inner pipe and said metal outer pipe between said first end area and said second end area, said plastic housing being molded onto said outer pipe to provide a molded-on housing, wherein molding-on contours, which form a positive-locking connection with said molded-on housing, are formed integrally at said second end area of said metal outer pipe.

14. An exhaust system in accordance with claim 13, further comprising a passive cooling structure on an outer side of said metal outer pipe, wherein said cooling structure comprises at least one of:

a plurality of ring disk-like cooling ribs, and a cooling coil wound helically around said outer pipe.

15. An exhaust system in accordance with claim 13, further comprising heat-insulating insulation material arranged in said annular gap.

16. An exhaust system in accordance with claim 13, further comprising a sliding fitting between said housing and said metal inner pipe.

17. An exhaust system in accordance with claim 13, further comprising:

an exhaust pipe through which exhaust gas of the exhaust system flows during the operation of the exhaust system, wherein:

said plastic housing is held at said metal inner pipe only via a single said metal outer pipe;

exhaust gas does not flow through said metal inner pipe during the operation of the exhaust system;

said metal inner pipe is connected to said exhaust pipe; and said exhaust system component is one of:

an active muffler, which is acoustically connected to the exhaust system via said metal inner pipe; and a Helmholtz resonator, which is acoustically connected to the exhaust system via said metal inner pipe.

18. An exhaust system component of an internal combustion engine exhaust system, the component comprising:

an inner pipe made of metal, which is exposed to exhaust gas during operation of the exhaust system;

a housing made of plastic, which encloses a working space; and an outer pipe made of metal, said outer pipe comprising a first end area connected to said inner pipe and a second end area rigidly connected to said housing and enclosing an annular space formed radially between said inner pipe and said outer pipe between said first end area and said second end area, said second end area having an outer second end area surface and an inner second end area surface, at least a portion of said housing enclosing said outer second end area surface and said inner second end area surface to form a positive-lock connection, said housing being connected to said outer pipe via said positive-lock connection.

19. An exhaust system component in accordance with claim 18, wherein said second end area outer surface and said second end area inner surface engage said housing.

20. An exhaust system component in accordance with claim 18, wherein:

said housing is molded onto said outer pipe to form a molded-on housing; and molding-on contours, which form a positive-locking connection with said molded-on housing, are formed integrally at said second end area of said outer pipe.

* * * * *